United States Patent [19]

Matsuda

[11] Patent Number: 4,936,123

[45] Date of Patent: Jun. 26, 1990

[54] KEY AND KEY ASSEMBLY

[76] Inventor: Yasuo Matsuda, 11-8 Kashidanishi 1-chome, Higashiosaka, Osaka, Japan

[21] Appl. No.: 375,427

[22] Filed: Jul. 3, 1989

[30] Foreign Application Priority Data

Jul. 11, 1988 [JP] Japan ..... 63-92322[U]
Nov. 24, 1988 [JP] Japan ..... 63-297381

[51] Int. Cl.[5] ..... A47G 29/10
[52] U.S. Cl. ..... 70/456 R; 70/459
[58] Field of Search ..... 70/456 R, 457, 458, 70/459; 206/37.37.8; D3/61, 62

[56] References Cited

U.S. PATENT DOCUMENTS 1,781,060 11/1930 Hill ..... 70/456 R
1,999,660 4/1935 Mosely ..... 70/456 R
2,734,624 2/1956 Kernicki ..... 70/456 R
3,522,829 8/1970 Weintraub ..... 70/458
4,637,236 1/1987 Almblad .
4,677,835 7/1987 Almblad .

FOREIGN PATENT DOCUMENTS 134982 9/1983 Japan ..... 70/458

*Primary Examiner*—Robert L. Wolfe
*Attorney, Agent, or Firm*—Todd A. Dawson; William F. Pinsak

[57] ABSTRACT

A key assembly which is composed of a flat key and a credit card-like key holder members. This assembly does not make the pocket bulky and can conveniently be used as a spare key for a car door lock, a building door lock, etc.

3 Claims, 3 Drawing Sheets

KEY AND KEY ASSEMBLY

BACKGROUND OF THE INVENTION

1. Field of The Invention

The present invention relates to a key usable as a spare key, and more particularly, to a key assembly for a car door lock, a building door lock and the like.

2. Description of The Prior Art

In general, keys for car door locks, building door locks and the like are held together by a ring type key holder and carried in a pocket. Such keys are usually made of thick material and comprise at their sides prominences and depressions which engage with prominences and depressions in key holes, as shown in FIG. 7, so that they are bulky. Therefore, most people do not like carrying many keys in their pocket. In particular, they do not carry spare keys any more. However, this often causes problems, such as when the car door is locked with keys left inside the car.

SUMMARY OF THE INVENTION

The object of the invention is to provide a new key assembly composed of a flat key and a flat key holder, in which the above prior art disadvantages have been avoided.

This and other objects can be achieved by the key assembly of the invention which comprises a flat key member for use as a spare key made of a thin sheet material which does not have the same thickness and grooves as those of a corresponding main key on its side and a card member for use as a key holder having a key hole adapted to hold the key member therein.

The invention may also comprise a key assembly composed of the flat key as described above and a flat key holder having a recess formed therein to hold the key member and means for mounting rotatably the key thereon.

DETAILED DESCRIPTION OF THE INVENTION

Figure 1:
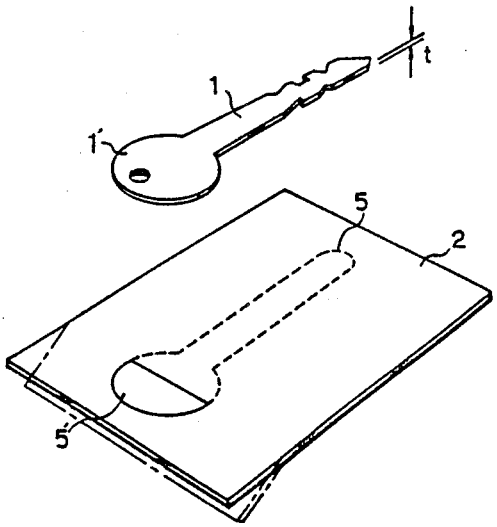
FIG. 1 is a perspective view of the key and key holder disassembled out of the key assembly according to the first embodiment of the invention.
Figure 2:
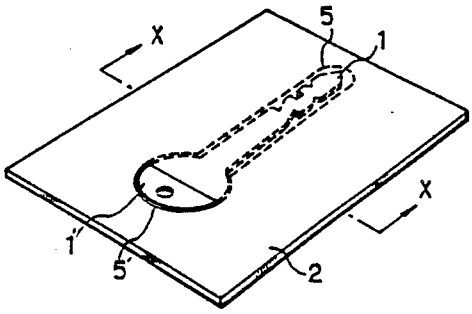
Fig. 2 is a perspective view illustrating the key assembly according to the invention.
Figure 3:
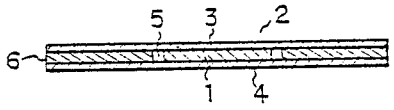
FIG. 3 is a sectional view taken along the line X—X of FIG. 2.
Figure 5:
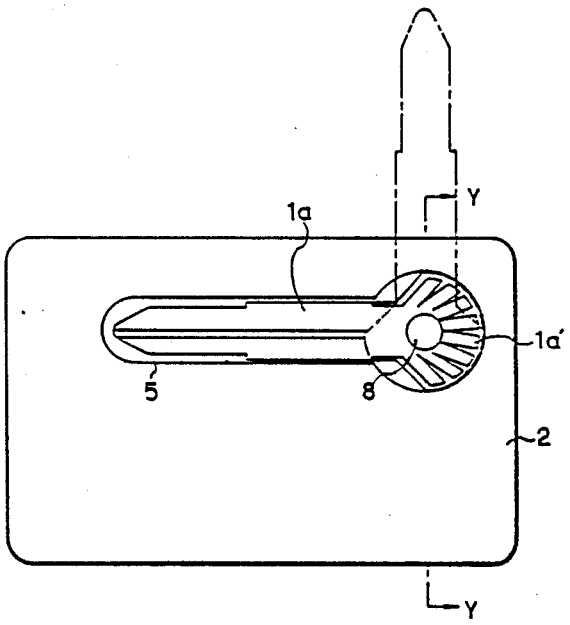
FIG. 5 is a plan view of the key assembly according to the fourth embodiment of the invention.
Figure 7:
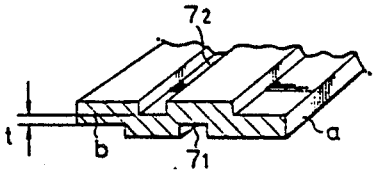
FIG. 7 is a fragmentary mid-sectionl view of a conventional main key.

Referring first to FIGS. 1 and 5, there are shown key members 1,1*a* according to the invention, which are used as spare keys, not as main keys. As shown in FIG. 7, a conventional key, i.e., a main key for a car door lock, a building door lock, etc. usually has at its sides grooves 71,72 which engage with prominences in a key hole of the car door lock, the building door lock and the like (not shown). However, the depth of grooves 71,72 does not usually exceed the imaginary center plane b and, therefore, there exists a thickness t between the bottoms of the grooves 71,72. The key members 1,1*a* of the invention are originated in view of the fact that a spare key which does not have grooves as described above at its sides, i.e., a spare key made of a thin sheet, can be inserted into a keyhole to which only a conventional main key can be inserted. In other words, the key members 1,1*a* of the invention have the same thickness as the thickness t or a thinner thickness than the said thickness t (shown in FIG. 7). That is, the key members 1,1*a* do not have any grooves 71,72 which require substantial thickness, and are made of a flat, thin sheet. The key members 1,1*a* are made of phosphorous bronze, steel, ceramic, stainless steel and the like. Further, the key members 1,1*a* are made by copying to have the same tooth profile as that of the main key as shown in FIG. 1 or are made by punching work to have the rough profile as shown FIG. 5 so that the same tooth profile as that of the main key can be obtained by the secondary work later.

On the other hand, a credit card-like member 2 which functions as a key holder is provided with a core sheet 6 having a key hole 5 at its central portion to hold the key member 1, and two thin films 3,4 adhered to both sides of the core sheet 6. The core sheet 6 is made of a synthetic resin sheet having the same thickness as the key member 1 or a thicker thickness than the said key member. An opening 5′ for inserting and taking out the key member 1 is formed in one of the two thin films 3,4. The core sheet 6, and the thin films 3,4 are of a flexible material and one or both of the films 3,4 may preferably be transparent.

Figure 6:
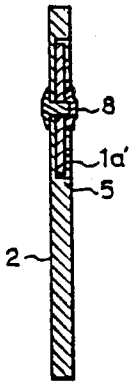
FIG. 6 is a sectional view taken along the line Y—Y of FIG. 5.

Referring now to FIGS. 5 and 6, there is shown a modified embodiment of the card-like key holder 2 of the invention. The holder 2 is made of a flexible thin sheet and comprises a recess 5 at its one side to hold the key member 1*a* and a means 8 for holding rotatably the key member 1*a* thereon. The means 8 for fastening the key member 1*a* on the holder 2 may be a rivet, a snap hook and the like. The means 8 operates to allow the key member 1*a* to rotate to the position shown in a dotted line in FIG. 5 while fastening the key member 1*a* on the holder 2.

Figure 4A:
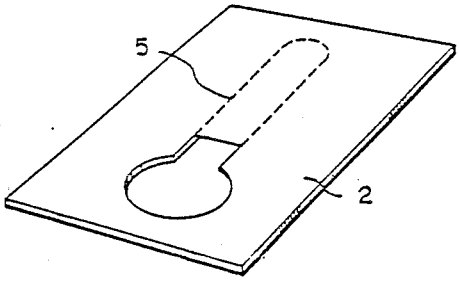
FIG. 4(*a*) and 4(*b*) are perspective views of the key assembly according to the second and third embodiments of the invention, respectively.
Figure 4B:
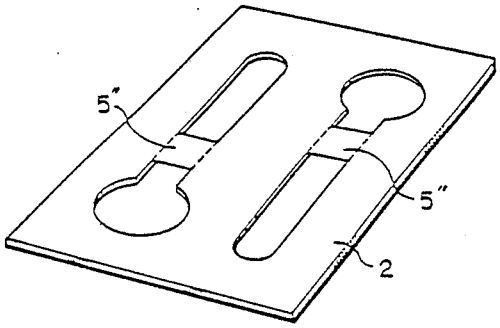

In the meantime, the opening 5′ for inserting and taking out the key 1 may be formed so that the grip portion 1′ of the key member 1 is completely exposed or only the teeth portion of the key 1 can be inserted into the key holder as shown in FIG. 4*a*. Further, multiple key holes or recesses 5″,5″ can be formed in the holder 2 side by side or on both sides to hold a car door key, a building door key, etc. at the same time.

In addition, the credit card-like holder 2 can show on its surface the printing such as various advertisements, descriptions, etc., so that it can be used widely as, for example, a membership card by making it a magnetic card or an IC card.

In the embodiments shown in FIG. 1 to FIG. 4, the portion about the opening 5′ is bent as shown in a dotted line in FIG. 1 due to the flexibility of the material for the holder 2 to help inserting and taking out of the key member 1.

In the embodiuments in FIGS. 5 and 6, the portion of the holder 2 about the key tip is bent due to the flexibility of the same material and the key member 1*a* is out of the recess 5 of the card member (holder) 2 to be able to rotate to the position as shown in a dotted line in FIG. 5. Thus, when the holder 2 is put in a wallet or a card case, the key is held stably in the keyhole or the recess and the holder 2 maintains a flat state to make overall thickness the same as or slightly thicker than the holder 2. The key does not have any grooves which the corresponding usual main key used to have, so that the key can be made of a thin sheet to allow it to be held in a keyhole or a recess of the thin card-like holder 2. As a result, the key does not make the wallet or the card case bulky when it is put in the wallet or the card case, so that it can be carried comfortably in a pocket.

Therefore, the key assembly of the invention will solve many problems such as the damage of car door locks when the car door is locked with keys left in the car.

What is claimed is:

1. A key assembly comprising a key member and a flat credit card-like card member having a recess to accommodate said key member on one side of said card member, said key member defining a key ring hole, and a means for rotatably coupling said card member to said key member at said key ring hole.

2. The key assembly of claim 1 wherein said coupling means is a rivet.

3. The key assembly of claim 1 wherein said coupling means is snap hook.

* * * * *